US005547136A

United States Patent [19]

Steffens et al.

[11] Patent Number: 5,547,136

[45] Date of Patent: Aug. 20, 1996

[54] ROTARY GRINDING APPARATUS FOR RECYCLING WASTE MATERIALS

[75] Inventors: Hermann J. Steffens, Statesville; Elwood L. Cunningham, Nebo, both of N.C.

[73] Assignee: Kathleen M. Smith-Steffens, Statesville, N.C.

[21] Appl. No.: 409,195

[22] Filed: Mar. 23, 1995

[51] Int. Cl.[6] ..... B02C 4/18

[52] U.S. Cl. ..... 241/73; 241/160; 241/224; 241/235; 241/242; 241/285.1; 241/294

[58] Field of Search ..... 241/73, 89.3, 235, 241/160, 294, 224, 242, 236, 243.2, 285.1

[56] References Cited

U.S. PATENT DOCUMENTS

| | | | |
|---|---|---|---|
| 526,043 | 9/1894 | Merrill . | |
| 691,582 | 1/1902 | Beam | 241/242 X |
| 1,423,867 | 7/1922 | Mitts et al. . | |
| 1,847,859 | 3/1932 | Beaumont | 241/242 X |
| 5,269,355 | 12/1993 | Bower . | |
| 5,285,973 | 2/1994 | Goforth et al. . | |
| 5,320,293 | 6/1994 | Laly et al. . | |

FOREIGN PATENT DOCUMENTS

| | | | |
|---|---|---|---|
| 3704725 | 8/1988 | Germany | 241/242 |
| 395110 | 1/1974 | U.S.S.R. | 241/235 |

*Primary Examiner*—Mark Rosenbaum
*Attorney, Agent, or Firm*—Cort Flint

[57] ABSTRACT

A heavy-duty grinder is disclosed having increased durability and longevity due to a construction that produces low mechanical vibrations and noises during operation. The grinder includes a pair of end plates, preferably solid steel, and a pair of cutting blade rotors carried between the end plates, which are also preferably machined from solid steel. A direct in-line hydraulic drive of the rotors is provided by hydraulic motors and compression fittings which lock the hydraulic motors to the rotors without the need of keys or splines. In this manner, a drive and construction is provided which accommodates load reverses, shocks, and shears encountered during the grinding process without detrimental effect to the mechanical integrity of the grinder. Machined blade pockets having recessed heels are formed on the periphery of the rotors. Knife blades are mounted in the recessed heels for reinforcement and support against cutting. An anvil is disposed in a cutting nip of the rotors having hardened cutting edges. The anvil is mounted by means of journal bosses so that it may be rotated during assembly so that the cutting edges of the rotor blades and anvil are precisely parallel and aligned before welding. Sieve screens carried closely adjacent the rotor surfaces control the size of the product. A first cutting of the material occurs between opposing blades of the two rotors prior to reaching the anvil, a second cutting occurs between the blades and the anvil, and a third cutting occurs between the cutting blades and the screens after passing the anvil.

31 Claims, 5 Drawing Sheets

Fig. 7.
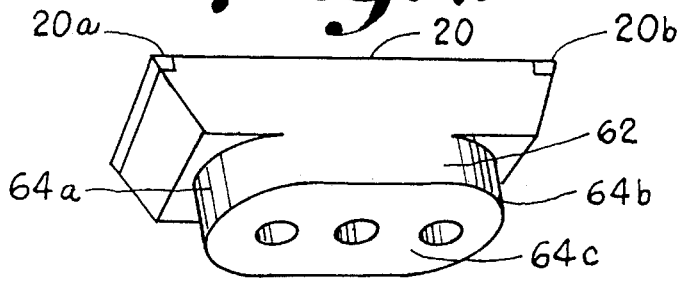
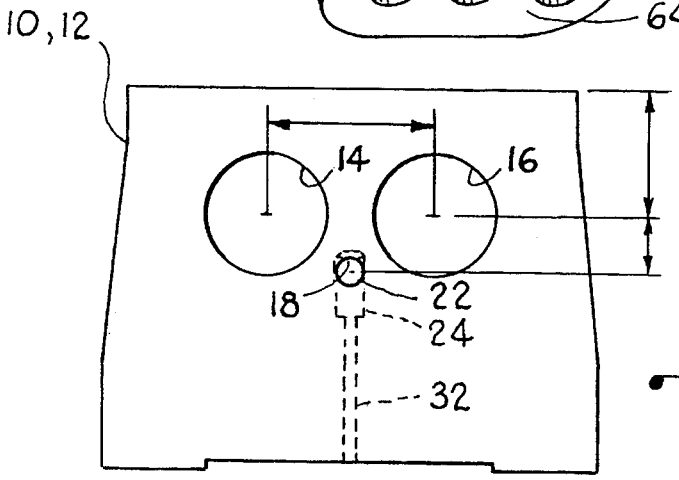
Fig. 9.
Fig. 8.
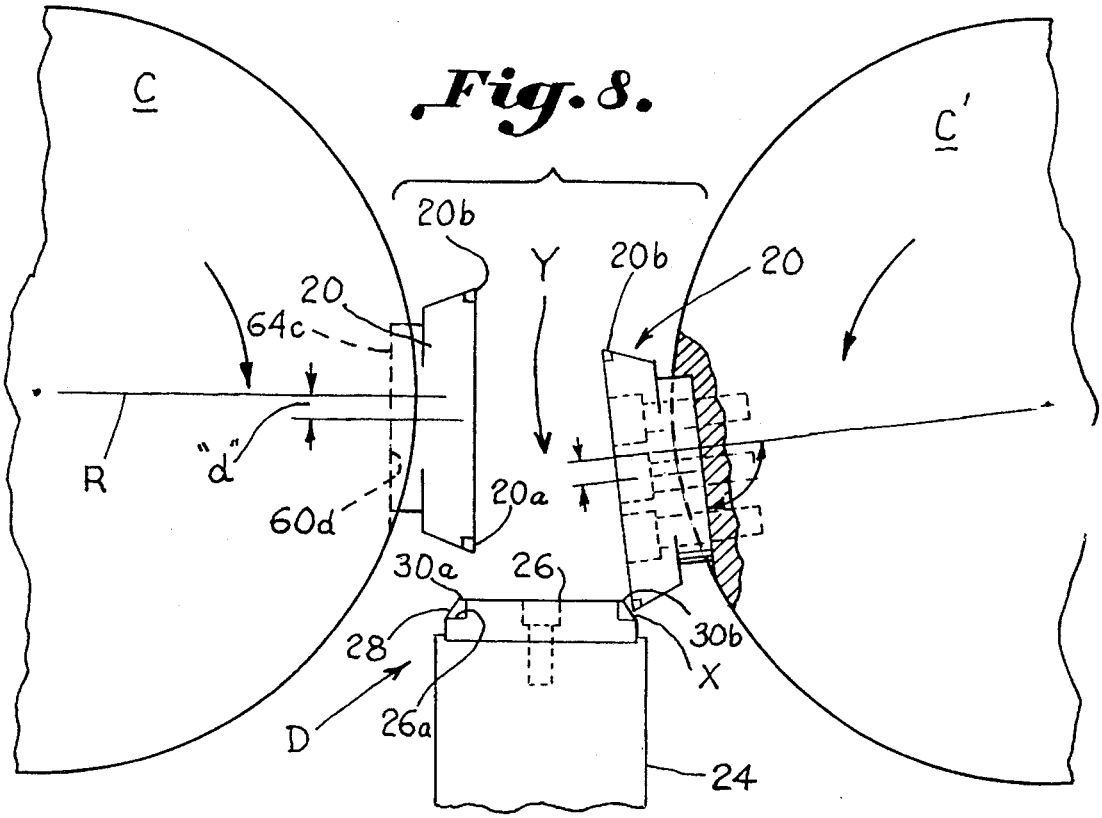

ROTARY GRINDING APPARATUS FOR RECYCLING WASTE MATERIALS

BACKGROUND OF THE INVENTION

This invention relates to an apparatus for grinding and comminuting wood and other materials, particularly for recycling the materials. In particular, the invention relates to an apparatus which may be provided for a wide variety of heavy-duty grinding processes such as for wood, plastics, paper, aluminum, asphalt, rubber tires, and the like with increased durability, longetivity, and reliability yet essentially without mechanical vibration and at a low noise level.

The invention mainly concerns the type of grinding apparatus known as a rotary grinder in which the material is ground by a combination of shock and shearing effects between the rotating blades of a grinding rotor and blade edge fixed on a frame on which the rotor is carried.

Previously, apparatus have been known commonly referred to as "breakers" which utilize a pair of hollow rotors having a plurality of cutting blades. The rotors are rotated toward a stationary anvil which breaks the material into chunks dropped through grates below the rotors. Typically, the blades are mounted to the rotors by machining out a straight circumferential cut-through on the surface rotor and bolting the blade to the rotor cut-through. While these breakers are suitable for some grinding processes, they lack the structural integrity for other heavy-duty grinding processes. In particular, the rotors of these grinders have been driven with electric motors through gear boxes and these drive arrangements have been problematic. In addition, the horsepower that can be utilized for grinding is limited by the gear box size which becomes prohibitively expensive for large electric motors possessing sufficient horsepower for heavy-duty grinding. Previous apparatus have been provided having a pair of rotors with intermeshing blade teeth typically referred to as "shredders" as illustrated in U.S. Pat. No. 5,285,973. This patent discloses the use of a hydraulic motor rather than the conventional electric motor arrangement. However, an addition coupling is utilized between the output shaft of the hydraulic motor and the shaft of the rotor.

U.S. Pat. No. 5,320,293 discloses a rotary grinder employing blades which are arranged in a pattern on the periphery of a rotor to affect a desired distribution of the material for grinding along the length of the rotor. In this blade pattern, a plurality of identical blades of small lengths with respect to the length of the rotor are mounted on the periphery of the rotor along certain regularly spaced apart generatrix lines. While this pattern may be suitable for its intended purpose, it may not be entirely satisfactory for others such as when utilizing a pair of opposing cutting blade rotors both of which are rotating toward cut edges of an anvil.

U.S. Pat. No. 5,269,355 discloses a cutting wheel for a stump grinder having cutting blades with a pair of opposed cutting edges which may be reversibly utilized by reversing the operation of the cutting wheel. The cutting blades are attached by bolts. U.S. Pat. Nos. 1,423,867 and 526,043 disclose alternate arrangements of mounting cutting blades to single rotor grinders.

Accordingly, an object of the present invention is to provide an improved grinding apparatus for heavy-duty applications for handling load reverses and/or shocks that occur in the grinding of the materials in a comminution process, e.g. grinding down of particles into smaller particles.

Another object of the invention is to provide a precisioned grinding apparatus which may be used in grinding heavy weight or light weight materials into a small size for recycling wherein the precisioned construction provides greater longevity, reliability, and productivity.

Another object of the invention is to provide a grinding apparatus for heavy-duty grinding processes which is constructed to operate essentially without mechanical vibration and at a low noises to provide a highly durable, long lasting grinding apparatus.

Yet another object of the invention is to provide a grinding apparatus having a pair of parallel cutting blade rotors with a plurality of cutting blades which cut against a cutting anvil disposed in a cutting nip of the rotors wherein precision, parallel alignment of the cutting blade rotors, anvil cutting edges, and screen sieve assemblies is provided for reducing waste material to small pieces and particles by repeated cutting.

Another object of the invention is to provide a grinding apparatus having a frame upon which at least one cutting blade rotor and cutting anvil are carried so that a clearance space between the anvil and cutting blade edges may be precisely set to provide comminution of a wide range of materials ranging from wood, metal, and to thin film plastic bags.

Another object of the present invention is to provide a rotary grinding apparatus having high structural integrity by mounting cutting blade rotors and a cutting anvil in solid plate sides in which bearing housings are disposed in close proximity to opposing end faces of the cutting blade rotors so that a tight, in-line direct drive of the cutting blade rotors may be had by means of concentrically mounted hydraulic motors wherein the rotors, rotor journals, bearings, and motor are compactly arranged in an in-line drive arrangement for transmitting high horsepower and torque to the cutting rotors.

Yet another important object of the present invention is to provide a rotary grinding apparatus having solid machined rotors with blade pockets machined in the periphery of the rotor having recessed heels which receive mounting blocks of cutting blades to support and reinforce the cutting blades against cutting.

Another object of the present invention is to provide a rotary grinding apparatus having one or more rows of axially and circumferentially spaced cutting blades arranged in at least one repeat of a diverging pattern wherein the blades diverge outwardly from a central cutting blade in the direction of rotation of the rotor to control the distribution of material along the rotors and the uniform cutting along a cut line along the length of the cutting rotor.

SUMMARY OF THE INVENTION

The above objectives are accomplished according to the present invention by providing a rotary grinding apparatus for grinding scrap material for recycling which comprises a frame with a first frame end, and a second frame end spaced from the first frame end. At least a first cutting blade rotor is rotatably carried by the first and second frame ends which has a plurality of cutting blades. Preferably, a second cutting blade rotor is rotatably carried by the first and second frame ends which has a plurality of cutting blades. An elongated cutting anvil is carried between the first and second frame ends longitudinally coextending with the first and second cutting blade rotors. The cutting anvil has first and second longitudinal cutting edges disposed in a material cutting relationship with the cutting blades of the first and second cutting blade rotors to define a precise, predetermined clearance between the cutting blades and the anvil cutting edges. A vertical support web is affixed between the frame ends integral and supporting the cutting anvil against cutting. A pair of converging infeed plates are carried adjacent an open top of the frame arranged at a prescribed angle to a cutting nip of the first and second cutting blade rotors for properly feeding the material to the rotors for cutting. First and second arcuate screen are carried longitudinally coextending with the first and second cutting blade rotors. The arcuate screens are carried in close proximity to the cutting blade rotors and have a plurality of perforations. The arcuate screens are contoured corresponding to the rotors to define a prescribed clearance between the cutting blades and the perforated screens so that the material is repeated comminuted until the material is reduced in size sufficiently to fall through the perforations of the arcuate screens.

In the preferred embodiment, the frame ends are provided by first and second solid frame end plates. First, second, and third cutout openings are machined in each of the first and second end plates. The cutout openings formed in the first and second end plates are in exact duplicate patterns of center-to-center spacing so that the first, second, and third cutout openings have their centers in precise opposing alignment. The first cutout openings have centers aligned along a first center axis. The second cutout openings have centers aligned along a second center axis. The third cutout openings have centers aligned along a third center axis. The first, second, and third center axes are arranged in precise, parallel alignment to each other. The first cutting blade rotor is rotatably carried in the first cutout openings of the first and second end plates. The second cutting blade rotor is rotatably carried in the second cutout openings of the first and second end plates. A boss carried on each opposing end of the cutting anvil is received in the third cutout openings of the first and second end plates in a manner that the anvil may be set in a precise level position to provide a precision alignment between the cutting edges of the rotor blades and the anvil.

In accordance with other features of the invention, a pair of first bearing housings are carried in the first cutout openings of the first and second end plates. A pair of second bearing housings are carried in the second cutout openings of the first and second end plates. The first cutting blade rotor has opposing bearing journals which are rotatably carried in the first bearing housings. The second cutting blade rotor has opposing bearing journals which are rotatably carried in the second bearing housings. A first hydraulic drive motor having a rotary output sleeve is provided. A first direct drive fitting connects the rotary output of the first hydraulic motor and a drive journal of the first cutting blade rotor so that the rotor axis and rotational axis of the rotary sleeve are coaxial. A second hydraulic drive motor is provided having a rotary output sleeve connected directly to the drive journal of the second cutting blade motor without need of keys and splines.

First and second motor housings are concentrically carried with the first bearing housing and the second bearing housing. The first and second hydraulic motors are carried respectively by the first and second motor housings. The respective hydraulic motors, motor housings, bearing housings, cutout openings, and cutting blade rotors are concentrically and coaxially arranged to define an in-line drive. Preferably, the first and second direct drive fittings include a compression connector which surrounds the drive sleeves of the hydraulic motors for clamping and locking the drive journals and drive sleeves together in a direct connection.

In other aspects of the invention, each of the cutting blade rotors is machined from solid stock, and comprises a plurality of blade pockets spaced axially and circumferentially about an outer surface of the rotors. The blade pockets include blade support heels which are machined and recessed in the rotor surface which enclose a rear portion of the blade pockets. The cutting blades include mounting blocks having at least one rounded body portion. The rounded body portions of the mounting blocks mate with and are received in the support heels of the blade pockets so that the mounting of the cutting blades is reinforced against cutting of the material. Advantageously, the blade pockets, and blades, are arranged in a generally "V-shaped" diverging pattern so that the blade pockets diverge in the direction of rotation of the first and second rotors from a central location to maintain an even distribution of the material which is being cut across a cut line defined between the cutting blades and the first and second cutting edges of the anvil. The diverging pattern of blade pockets, and blades, preferably includes a first row of pockets which has a center pocket and blade pockets spaced on opposing sides of the center pocket diverging axially and circumferentially in the direction of rotation so that the tendency of the cut material to spread towards the ends of the cutting rotors is reduced. A second row of diverging blade pockets trails the first row of blade pockets. The blade pockets of the second row include center lines which are laterally off-set from the center lines of the blade pockets of the first row so that a substantially continuous cut line is provided by cutting blades mounted in the first and second rows of blade pockets along an axial length of the cutting blade rotors. Advantageously, the cutting anvil includes an anvil block and a replaceable bed knife carried by the anvil block having a pair of cutting edges against which the material is cut. By providing bed knives of different heights mounted to the anvil block, the cutting clearance between the cutting edges of the rotor cutting blades and the cutting anvil can be varied as desired according to the material being recycled.

The anvil includes an anvil block and a bed knife carried by the anvil block which has a pair of corner cutouts, and hardened material inserts carried in the corner cutouts forming the first and second cutting edges. The support web includes a vertical plate extending between the first and second end plates which supports the anvil block against cutting.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 6 is a perspective view illustrating an end of a cutting blade rotor constructed according to the invention and disposed in cutting relationship to an anvil having a pair of longitudinal cutting edges which cooperate with the cutting blades of a pair of cutting rotors for comminuting waste material and the like;

FIG. 7 is a bottom perspective view illustrating a cutting knife having a pair of cutting edges according to the invention;

FIG. 8 is a schematic view illustrating a cutting relationship of a pair of cutting blade rotors disposed in cutting relationship to a cutting anvil having a pair of cutting edges in accordance with the invention; and FIG. 9 is a side elevation illustrating the precision machined cutouts in side plates of a grinder frame according to the invention which allows precision, parallel alignment of cutting rotors and a cutting anvil.

DESCRIPTION OF A PREFERRED EMBODIMENT

Figure 1:
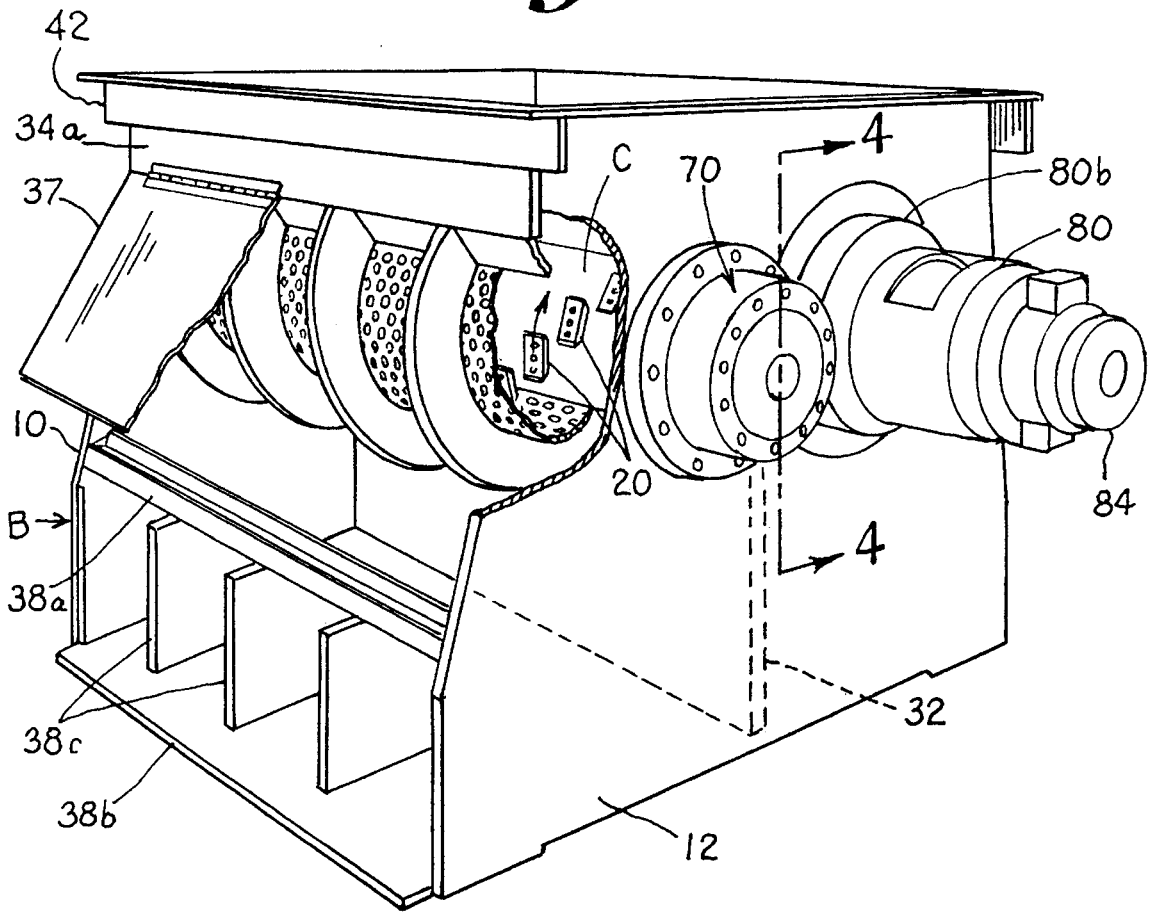
FIG. 1 is a perspective view with parts cut away illustrating a heavy-duty rotary grinder constructed according to the present invention.

Referring now to the drawings, the invention will now be described in more detail. FIG. 1 is a perspective view of a rotary grinding apparatus according to the invention, designated generally as A, which includes a heavy-duty, open-top frame B having a pair of solid steel end plates 10, 12 which are machined from a quenched and tempered 4140 steel. Each end plate is approximately one to two inches thick depending on the length of the grinder. Grinders sixty inches, one-hundred twenty inches, and longer are contemplated. Each end plate includes three cutout openings 14, 16, 18, preferably circular, which are machined in the plates and are located precisely on centers relative to each other (FIG. 9). When the frame is assembled, the center axes of the circular openings are parallel to one another.

Carried in cutout openings 14 is a cutting blade rotor C and carried in the cutout openings 16 is a second cutting blade rotor C'. The rotors are identical, as are the openings in which they are carried. Each rotor carries a plurality of knife blades 20. Third circular cutout openings 18 are used for supporting a cutting anvil, designated generally as D, and aligning the anvil and its cutting edges in a precise cutting relationship with the cutting blade rotors. For this purpose, anvil D includes an alignment journal boss 22 on each end received in circular openings 18 for aligning the anvil with the cutting rotors C, C'. Cutting anvil D includes a rectangular anvil block 24 having supporting edges 24*a* between which a bed knife 26 is supported. The bed knife has cutout corners at 26*a*. A hardened alloy 28 is welded into the machined cutouts 26*a* to provide two hardened cutting edges. The same may be provided for the knife blade edges 20*a*, 20*b*. The edges of the bedding knife are then precision ground to provide precision cutting edges 30*a*, 30*b* which are aligned and set with the cutting blades 20. Bed knife 26 is preferably provided in sections (twenty four inches or twelve inches) which are bolted to the anvil block. An anvil support web 32 is carried underneath anvil block 20 along the entire length of the rotors between end plates 10, 12, as can best be seen in FIG. 1. The vertical support web is welded to the full length of the underneath of block 24 anvil as well as the end plates 10, 12. This ensures that there is no deflection between the moving, cutting blades and the anvil to prevent destruction of the machine as may happen if the cutting parts become out of alignment or loose. Prior to welding, or other fixing of the anvil in place, a precision alignment of the anvil cutting edges 30*a*, 30*b* with the blade cutting edges 20*a*, 20*b* is made. As can best be seen by reference to FIGS. 8 and 9, this is accomplished with the journal bosses 22 being loosely rotatably disposed within cutout openings 18 as the anvil D is carried between end plates or frame ends 10, 12 without affixation or welding. The entire anvil D is rotated so that the bed knife 26 is exactly level. Since the cutout openings 14, 16 for the cutting rotors C, C' and cutout opening 18 for the anvil journal bosses are on precise centers relative to each other, the leveling of the anvil and bed knife 26 creates a precise, predetermined cutting clearance "X" between the anvil cutting edges and rotor blade cutting edges (right most cutting blade, FIG. 8) as they come closest together in the cutting nip "Y". By providing bed knife 26 in predetermined heights, preselected, precise cutting clearance "X" may be provided for cutting virtually any material into small enough pieces for recycling. For example, cutting clearance "X" may be set as low as one-tenth of a millimeter (0.1 mm) for cutting and recycling plastic grocery or trash bags. Typically, this clearance is between one to one-tenth of a millimeter. In one application to recycling wood pallets and other wood wastes, the cutting clearance was one millimeter (1.0 mm).

A pair of arcuate sieve screen assemblies 30, 32 is carried closely next to rotors C, C' having perforations 30*a*, 32*a* which control the finished product size. There is a close clearance "Z" between the cutting blades 20 and the screen to further cut the material after passing through the cutting nip "Y". In the above example for wood wastes, this clearance may be one-half to three-quarters inch for an eighteen inch rotor diameter, and the screen perforations were about one and one-quarter inches in diameter. There are three cutting actions in the grinding process of the rotary grinder according to the invention. First, as the material enters the grinder, the material is cut by approaching cutting blades 20 of adjacent cutting rotors B, B' on their downward travel toward anvil D. Second, the material is cut as it passes between the blade cutting edges and anvil cutting edges. Third, the material is cut as it is encountered between the screens and the cutting blades. Repeated cutting of the material by the cutting blades and comminution occurs as the material is caught between the cutting blades and screen until the material is small enough to fall through the perforations of the screen.

Figure 3:
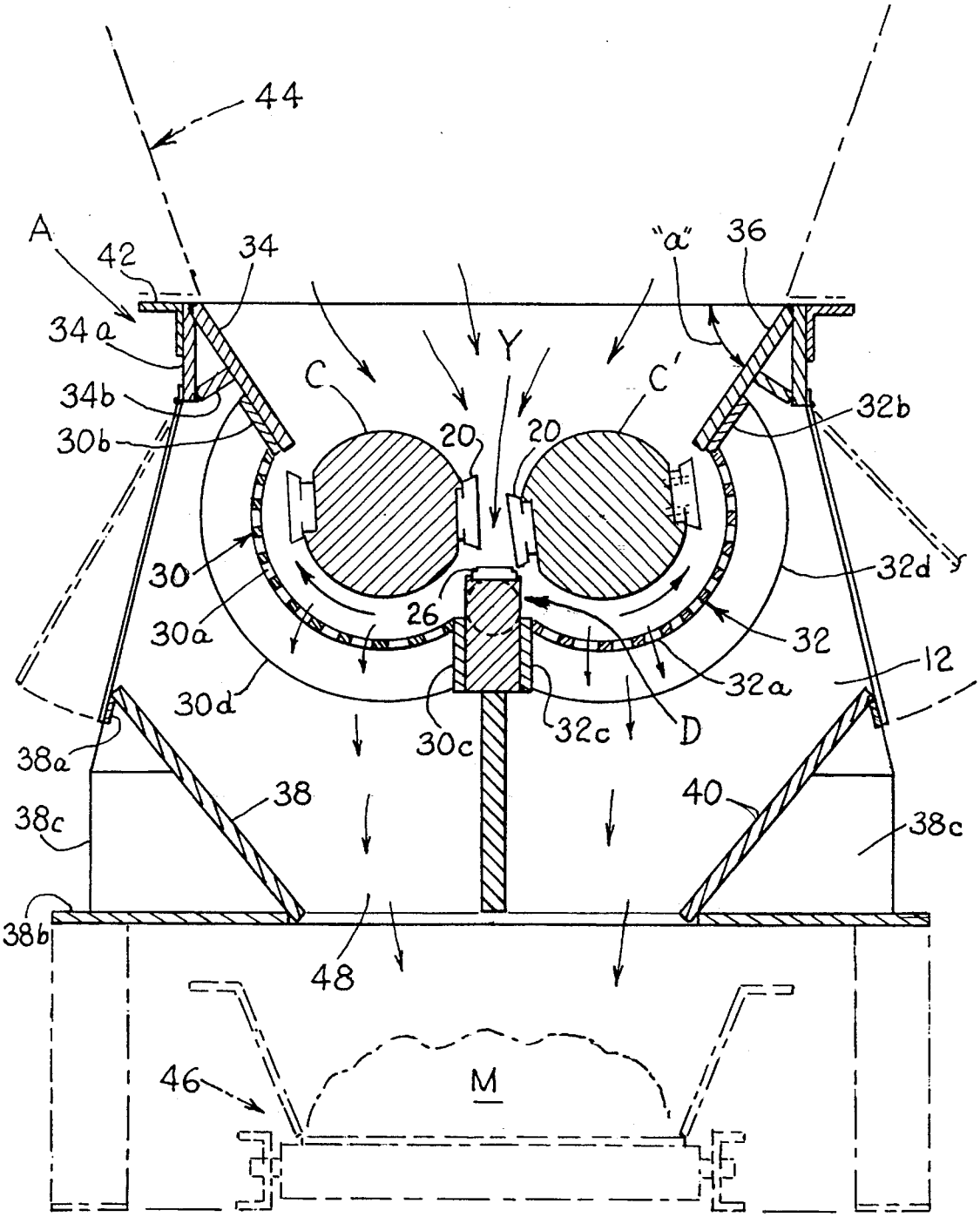
FIG. 3 is a sectional view taken along line 3—3 of FIG. 2 with a feed hopper and outfeed conveyor shown in phantom lines.

As can best be seen in FIGS. 1 and 3, frame B further includes a pair of infeed plates 34, 36 which extend the length of the grinder and are welded to the opposite end plates 10, 12. The angle "a" between the infeed plates and the top of the grinder is approximately fifty-five degrees, and is important to ensure proper feeding of the material (FIG. 3). If the angle is too great, the material tends to be caught by the blade in its upward travel and slung out of the hopper. If the angle is too shallow, the feed area is reduced too much and the material doesn't feed properly, reducing the production of the machine. Adjacent the bottom of the end plates are a pair of angled outfeed plates 38, 40, also welded between the end plates, which direct the ground material "M" onto a conveyor 46 below the grinder. Outfeed plate 38 is supported by a horizontal brace 38*a* welded between the end plates, a bottom plate 38*b*, and a plurality of knee braces 38*c* affixed between the brace and bottom plate. Outfeed plate 40 is provided with identical support structure. Screens 30, 32 include outer edges 30*b*, 32*b* welded or bolted to infeed plates 34, 36, and include inner edges 30*c*, 32*c* welded or bolted to anvil block 24. Screen ribs 30*d*, 32*d* reinforce the screens. Infeed plate brace 34*a* is also welded between the end plates with a reinforcing angle 34*b*. The same is provided for infeed plate 36. This completes the heavy-duty frame B. Hinged doors 37 may be provided for closing the sides of the frame.

As can best be seen in FIG. 3, there is a peripheral flange 42 surrounding the open top of the grinder to which a conventional hopper feeder, shown in phantom lines at 44, may be attached for feeding material to the grinder. A conventional outfeed conveyor, shown in phantom lines at 46, is disposed below outfeed openings 48 to convey cut and ground material "M" away.

Figure 5:
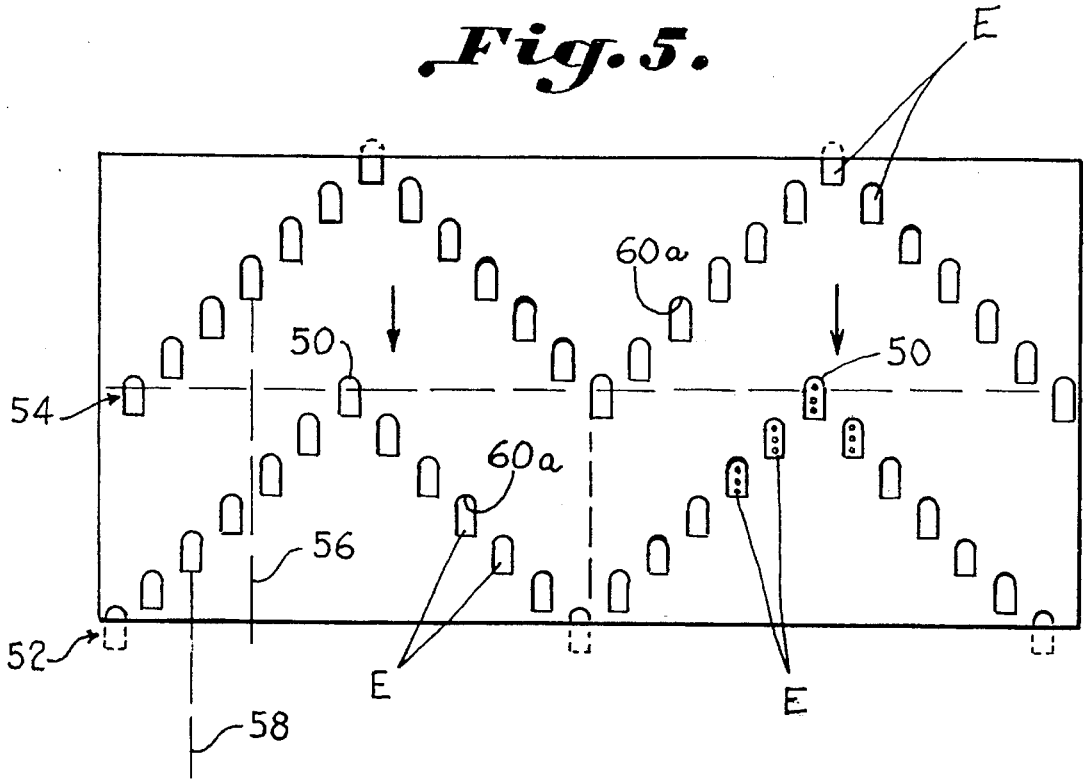
FIG. 5 is a plan pattern view of a cutting blade and a blade pocket pattern for a cutting blade rotor according to the invention.
Figure 6:
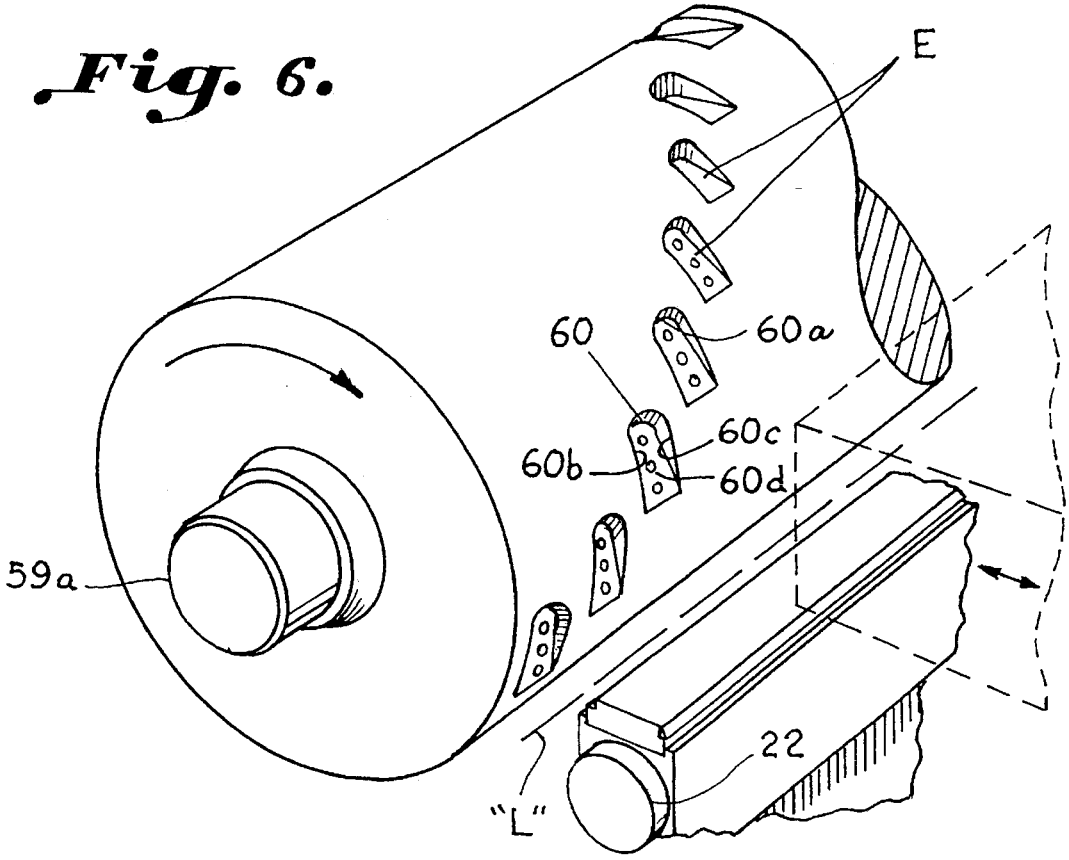

Referring now in more detail to FIGS. 5, 6, the description of the cutting blade rotors will now be made. The cutting rotors C, C' are machined from a solid piece of 4140 quenched and tempered steel, and may have a diameter from fourteen to twenty-four inches depending on the material being ground. The cylindrical peripheries of cutting blade rotors C, C' include a plurality of blade pockets, designated generally as E, spaced axially and circumferentially about an outer surface of the rotors. The blade pockets are arranged in a diverging pattern in which the blade pockets E diverge in the direction of rotation of the first and second rotors to maintain an even distribution of the material along a cut line "L" defined between the cutting blades and the first and second cutting edges of the anvil. Preferably, the diverging pattern of blade pockets E includes a first row 50 of pockets in at least one repeat of a generally v-shaped pattern which includes a center pocket 52 with blade pockets E spaced on opposing sides of the center pocket diverging axially and circumferentially in the direction of rotation so that the tendency of the cut material to spread towards the ends of the cutting rotors is reduced. Preferably, the diverging pattern includes a second row 54 of diverging blade pockets trailing the first row of blade pockets. The blade pockets of the second row 54 include center lines 56 which are laterally off-set from the center lines 58 of the blade pockets of first row 50 so that a substantially continuous cut line is provided by cutting blades mounted in the first and second rows of blade pockets along an axial length of cutting blade rotors C, C'. The number of rows will depend on the diameter of the rotor. The number of v-shaped or diverging patterns repeated in a row will depend on the axial length of the rotor. For example, the embodiment illustrated in FIG. 5 of two pattern repeats is for a one-hundred and twenty inch grinder rotor. In the case of a sixty inch rotor, only one v-shaped pattern row for each row 50, 54 would be utilized. The blade pockets of each row are displaced thirty degrees around the circumference of the rotor surface.

Due to the fact that the end plates and rotors are solid, machined steel, a very durable rotor assembly is provided. Each rotor is machined with a pair of bearing journals on each end a drive journal on one end, as can best be seen in FIG. 4. The bearing journals are shown at 59*a*, 59*b* and the drive journal is shown at 59*c*.

Referring again to FIGS. 5 and 6, it can be seen that blade pockets E include recessed support heels 60 in the form of an arcuate blade support surface 60*a* machined at a rear portion of each blade pocket. The cutting blades include mounting blocks 62 having at least one rounded body portion, and preferably two rounded body portions 62*a*, 62*b*. The rounded body portions of the mounting blocks mate with and are received against support heels 60 of blade pockets E so that the support heels reinforce the mounting of cutting blades 20 against cutting. This distributes the pressures encountered by blades 20 when striking the material over a larger surface area to reduce the forces on the blades.

The blade pockets are machined in the surface of the solid rotor to include the arcuate back surface and two parallel side surfaces 60*b*, 60*c* so that mounting blocks 62 and blades 20 may be reversibly positioned. As can best be seen in FIG. 7, each cutting blade includes mounting block 62 in the form of an oval base having rounded portions 64*a*, 64*b* which correspond to the arcuate recessed heel 60 of the blade pockets so that the blades may be reversibly positioned in the blade pockets. In this manner, the pair of cutting edges 20*a*, 20*b* may be interchanged to extend blade life in the cutting of material in all three cutting processes. The cutting blades are bolted into the blade pockets by using Grade 8 socket head fasteners. As can best be seen in FIG. 8, the knife blade 20 is off-set in a forward cutting direction with respect to the diameter or radius at the blade pocket. The center of blade 20 is offset in the direction of rotation a distance "d" from a radial "R" perpendicular to bottom surface 60*d* of blade pocket E (and the base 64*c* of mounting block 62). This ensures that the blade is at a proper cutting angle with adequate clearance between the rear cutting edges of blades travelling past the anvil to avoid engagement. With the top surface of the bedding knife set laterally level and parallel to a line passing through the center of the rotors, the cutting blades and anvil edges are in proper alignment for proper cutting angle, and clearance. The knife blades are disposed a cutting angle of about ten degrees to the anvil.

Figure 4:
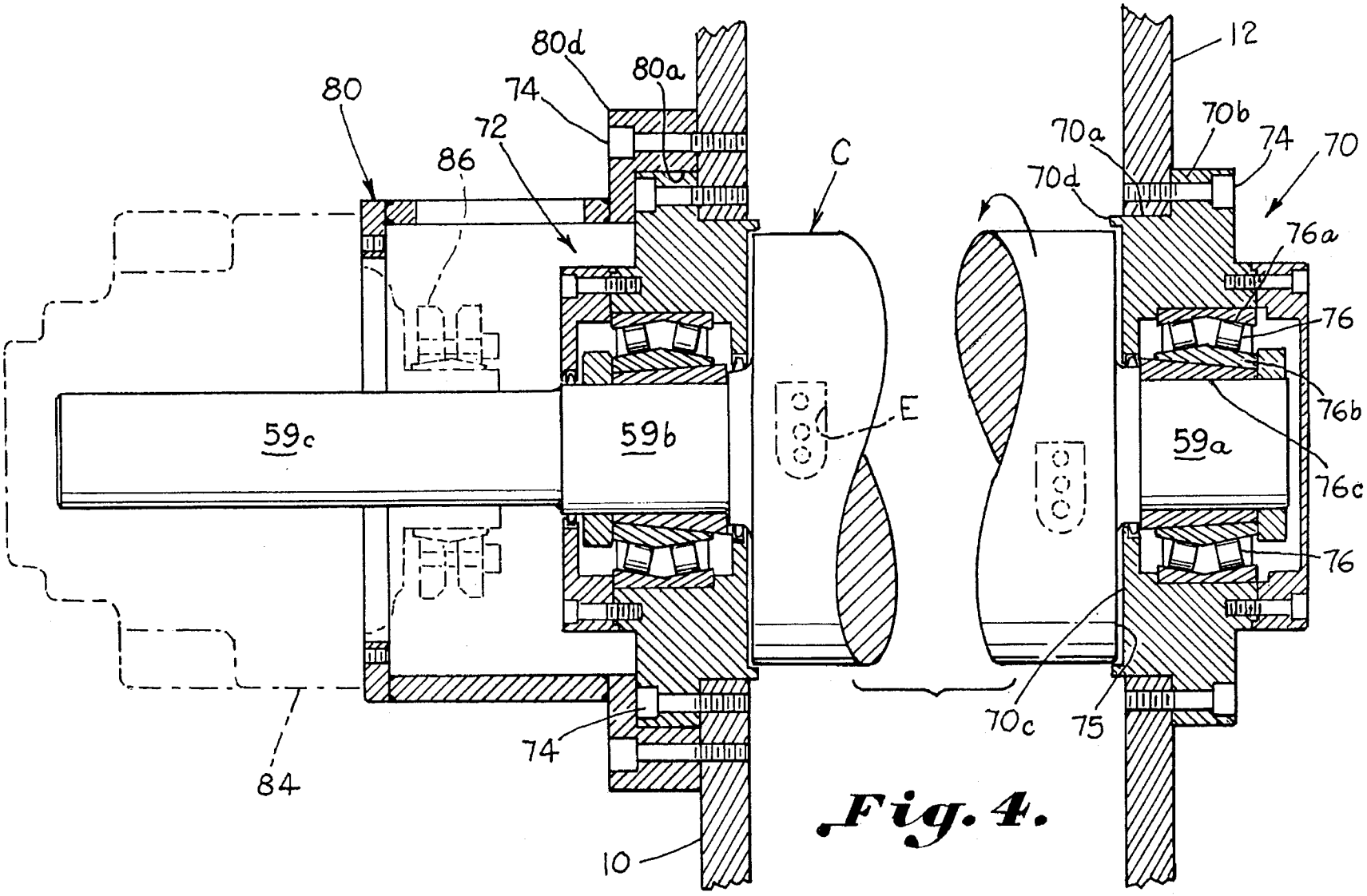
FIG. 4 is a sectional view taken along line 4—4 of FIG. 1.

As can best be seen in FIG. 4, one of the important advantages of the present invention is the hydraulic, in-line drive for the cutting rotors. There are two, oversized bearing housings, denoted generally as 70, 72, fitted into the opposing openings of circular cutouts 14, 18 which have been precision drilled in the end plates. The bearing housings may be identical, and accordingly, only one of the bearing housings will be described. For example, bearing housing 70 includes a circumferential shoulder 70*a* which forms a precision fit within the internal circumference of the precision drilled openings 14, 16. There is a radial mounting flange 70*b* integral with shoulder 70*a* which fits flush with the outside surface of the end plate. Circumferential shoulder 70*a* and mounting flange 70*b* are formed at ninety degrees so that they form a precision fit with the circle opening of the end plate. This ensures bearing alignment and no vibrations. The bearing housings are bolted onto the end plates by utilizing conventional fasteners 74 extended through flange 70*b*. Each bearing housing includes a bearing housing face 70*c* which faces and is very close to the cutting blade rotor end surface 75, as can best be seen in FIG. 4. There is also an annular lip 70*d* which seals the rotor against the space defined between the housing face 70*c* and the rotor end surface 75. This keeps material from entering into bearings 76 as would be detrimental to the operation of the bearing. Annular lip 70*d* is a circumferential lip that encompasses the entire circumference of the rotor. Bearing 76 includes an outer race 76*a*, an inner race 76*b*, roller bearings 76*c* carried between the races, and a tapered sleeve 76*d* for fitting the bearing onto the rotor journal 50. Bearing housing 72, on the opposite end which receives journal 52, is likewise provided.

Figure 2:
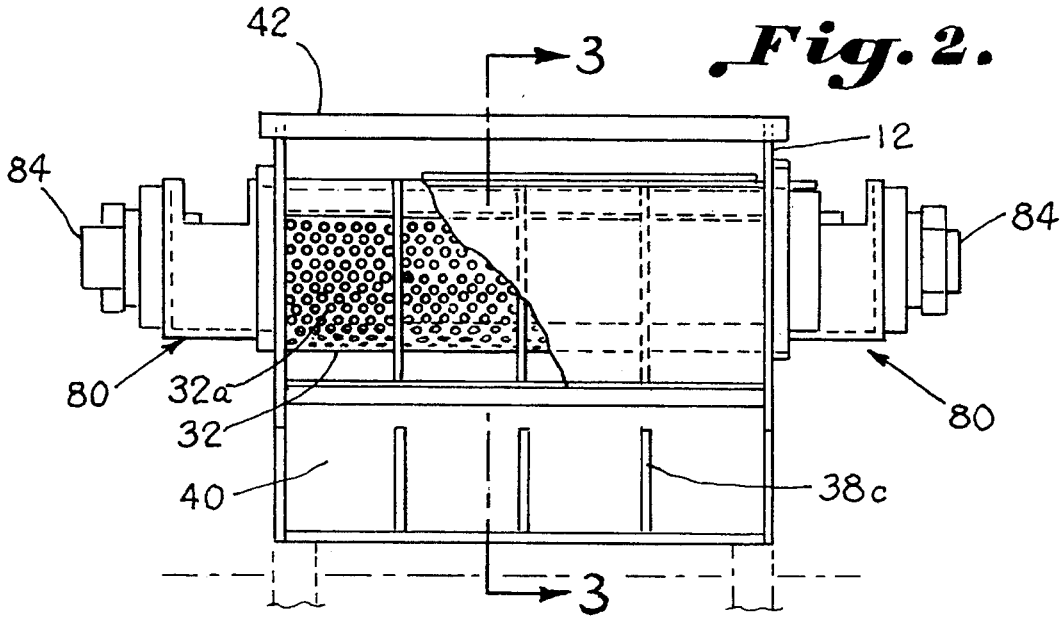
FIG. 2 is a side elevation with parts cut away of the heavy-duty rotary grinder of FIG. 1.

As can best be seen in FIGS. 2 and 8, there is a motor mount housing, designated generally as 80, which fits over bearing housing 72 in the following manner. There is an internal counterbore 80*a* machined into a mounting hub 80*b* of motor mount 80 which fits over radial mounting flange 72*b*, as described previously, with reference to bearing housing 70. Again, a precision fit is machined between counterbore 80*a* and bearing mounting flange 72*b* of bearing housing 72 to ensure a tight, non-vibrating fit, and axial alignment. Mounting hub 80*b* of the motor housing includes a plurality of openings through which conventional fasteners 74 are received to bolt the motor housing to end plate 12 as the circumferential counterbore 80*a* surrounds bearing housing 72. There is a hydraulic motor 84 bolted onto each motor housing 80 connected to a suitable source of pressurized hydraulic fluid (not shown) in a conventional manner for driving and controlling the motor in the wood pallet example, hydraulic motors having a capacity of 92 gpm were utilized with a three-hundred horsepower pumping motor. Motor 84 has a rotary output in the form of a hollow drive sleeve 84*a* which receives drive journal 54 of cutting blade rotor C. There is a compression fitting 86 mounted over the drive sleeve 84*a*. The compression fitting may be any suitable compression type fitting for locking the shaft and sleeve together in a non-slipping arrangement without the need of a key or spline. For example, a standard "shrink disk" such as one known as a "ringfeeder" manufactured by the Hagglands Divers Company of Mellansel of Sweden may be utilized, as illustrated at 86. Such a fitting has a pair of opposed plates bolted together so that as the bolts are tightened, the plates move upward over beveled surfaces of a split ring to compress the ring and fitting upon the shafts. In the present invention, the shock and shear forces encountered during cutting tend to tighten the fitting between the drive sleeve and rotor drive journal. At the same time, the hydraulic motor and drive produce a forgiving reaction force, both of which are an expedient as a rotary drive for a rotary grinder according to the invention. As can thus be seen, the drive for the cutting blade rollers includes various components which are aligned in a precision manner with one another relative to the precision machined openings 14, 16. The need for gear boxes and other drive couplings between previously used motors and grinding rotors is eliminated. The hydraulic drive provides a cushioned drive arrangement which is forgiving as the material, cutting blades and anvil are engaged with one another under high impacts. Everything is based on the center line of the cutting rotor shaft wherein the cutting rotor, center line of the cutting rotor, circular opening 14, bearing housing, motor housing, and motor are all precision aligned along the axis.

While the invention has been described in reference to an embodiment using two cutting blade rotors C, C', which is advantageous in many applications, it is to be understood that only one rotor may be used in some applications while still retaining many advantages of the invention. In that case, a pusher plate (dotted lines) may be utilized to feed material to the cutting nip between the rotor and anvil (FIG. 6).

While a preferred embodiment of the invention has been described using specific terms, such description is for illustrative purposes only, and it is to be understood that changes and variations may be made without departing from the spirit or scope of the following claims.

What is claimed is:

1. A grinding apparatus for grinding scrap material for recycling comprising:

a first frame end plate;

a second frame end plate spaced from said first end plate;

first, second, and third cutout openings formed in each of said first and second end plates;

said cutout openings being formed in said first and second end plates in exact duplicate patterns of center-to-center spacing so that said first, second, and third cutout openings have their centers in precise opposing alignment;

said first cutout openings in said first and second end plates having centers aligned along a first center axis, said second cutout openings in said first and second end plates having centers aligned along a second center axis, and said third cutout openings in said first and second end plates having centers aligned along a third center axis;

said first, second, and third center axes being arranged parallel to each other;

a first cutting blade rotor rotatably carried in said first cutout openings of said first and second end plates having a plurality of cutting blades;

a second cutting blade rotor rotatably carried in said second cutout openings of said first and second end plates having a plurality of cutting blades;

a cutting anvil disposed adjacent said first and second cutting blade rotors having first and second cutting edges disposed in a material cutting relationship with said rotor cutting blades; and a boss carried on each opposing end of said anvil received in said third cutout openings of said first and second end plates in a manner that said anvil may be set in a position to provide a precision alignment between said cutting blades on said rotors and said cutting edges of said anvil.

2. The apparatus of claim 1 including:

a pair of first bearing housings carried in said first cutout openings of said first and second end plates;

a pair of second bearing housings carried in said second cutout openings of said first and second end plates;

said first cutting blade rotor having opposing bearing journals rotatably carried in said first bearing housings; and said second cutting blade rotor having opposing bearing journals rotatably carried in said second bearing housings.

3. The apparatus of claim 2 comprising:

a first hydraulic drive motor having a rotary output with an axis of rotation;

a first direct drive fitting connecting said rotary output of said first hydraulic motor and a drive journal of said first cutting blade rotor so that said rotor axis and rotational axis of said rotary sleeve are coaxial;

a second hydraulic drive motor having a rotary output with an axis of rotation; and a second direct drive fitting connecting said rotary output of said second hydraulic motor and said drive journal of said second cutting blade motor so that said rotor axis and rotational axis of said rotary sleeve are coaxial.

4. The apparatus of claim 3 comprising:

a first motor housing concentrically carried with said first bearing housing on said first end plate;

a second motor housing carried concentrically with said second bearing housing on said second end plate;

said first and second hydraulic motors being carried respectively by said first and second motor housings; and said respective hydraulic motors, motor housings, bearing housings, cutout openings, and cutting blade rotors being concentrically and coaxially arranged to define an in-line drive.

5. The apparatus of claim 3 wherein:

said first and second rotary outputs include hollow drive sleeves for receiving said drive journals of said first and second cutting blade rotors; and said first and second direct drive fittings include a compression connector surrounding said drive sleeves of said hydraulic motors for clamping and locking said drive journals and drive sleeves together to provide a direct connection between said drive sleeves and said drive journals of said cutting blade rotors.

6. The apparatus of claim 1 wherein each of said cutting blade rotors comprises a plurality of blade pockets spaced axially and circumferentially about an outer surface of said rotors;

said blade pockets including blade support heels recessed in said rotor surface which enclose a rear portion of said blade pockets;

said cutting blades including mounting blocks having at least one rounded body portion; and said rounded body portions of said mounting blocks mating with and being received in said support heels of said blade pockets so that said support heels reinforce the mounting of said cutting blades against cutting of said material.

7. The apparatus of claim 6 wherein said blade pockets are arranged about a periphery of said rotor in a diverging pattern in which said blade pockets diverge in the direction of rotation of said first and second rotors from a central location to maintain an even distribution of said material for fitting across a cut line defined between said rotor cutting blades and said first and second anvil cutting edges.

8. The apparatus of claim 7 wherein said diverging pattern of blade pockets includes a first row of pockets having at least one repeat of a generally uniform v-shaped pattern, said pattern includes a center pocket with blade pockets spaced on opposing sides of said center pocket diverging in an axial and circumferential direction so that the tendency of said cut material to spread towards the ends of said cutting rotors is reduced.

9. The apparatus of claim 8 including a second row of blade pockets trailing said first row of blade pockets diverging uniformly in at least one repeat of said generally v-shaped pattern, and said blade pockets of said second row include center lines which are laterally off-set from the center lines of said blade pockets of said first row so that a substantially continuous cut line is provided by cutting blades mounted in said first and second rows of blade pockets along an axial length of said cutting blade rotors.

10. The apparatus of claim 8 wherein said cutting blade rotors are machined from a solid stock of steel.

11. The apparatus of claim 1 wherein said cutting blades are arranged in at least one repeat of a diverging pattern in which said cutting blades diverge in the direction of rotation of said first and second cutting blade rotors to maintain the distribution of material being cut generally uniform along a cut line defined between said cutting blades and said first and second cutting edges of said anvil.

12. The apparatus of claim 11 wherein said diverging pattern of cutting blades on each said cutting rotor include at least a first row of axially and circumferentially spaced blades having a center blade with spaced blade pockets on opposing sides of said center pocket diverging in an axial and circumferential direction so that the tendency of said cut material to spread towards the ends of said cutting rotors is reduced.

13. The apparatus of claim 12 including at least a second row of cutting blades trailing said first row of blades arranged in at least one repeat of said diverging pattern wherein center lines of said blades of said second row are laterally off-set from the center lines of said blades of said first row so that a substantially continuous cutting line is presented by said first and second row of blades.

14. The apparatus of claim 13 wherein said cutting blades of said second rows laterally overlap said blades of said first row in said axial direction to ensure cutting across the entire length of said first and second rows of blades.

15. The apparatus of claim 1 wherein said anvil includes an anvil block and a bed knife carried by said anvil block having a pair of cutting edges against which said material is cut.

16. The apparatus of claim 15 including a support web disposed below said anvil block for supporting said anvil against cutting.

17. The apparatus of claim 15 wherein said support web includes a vertical plate extending between said first and second end plates which supports said anvil block against cutting.

18. The apparatus of claim 1 including arcuate screens having a plurality of perforations carried in close proximity to said cutting blade rotors and being contoured corresponding to said rotors to define a prescribed clearance between said cutting blades and said perforated screens so that said material is repeated comminuted until said material is reduced in size sufficiently to fall through said perforations of said arcuate screens.

19. The apparatus of claim 1 wherein said first and second end plates include solid metal plates, and said cutout openings in said solid metal plates include machined openings.

20. The apparatus of claim 1 wherein a center of said cutting blades carried on said rotor is off-set in the direction of rotation a prescribed distance from a radial of said rotor perpendicular to a bottom surface of said blade pocket to ensure that a clearance is provided between rear cutting edges of said blades travelling past the anvil adequate to avoid engagement.

21. A grinding apparatus for grinding scrap material for recycling comprising:

a frame having a first frame end, and a second frame end spaced from said first frame end;

a first cutting blade rotor rotatably carried by said first and second frame ends having a plurality of cutting blades;

a second cutting blade rotor rotatably carried by said first and second frame ends having a plurality of cutting blades;

an elongated anvil carried between said first and second frame ends longitudinally coextending with said first and second cutting blade rotors;

said elongated anvil having first and second longitudinal cutting edges disposed in a material cutting relationship with said cutting blades of said first and second cutting blade rotors to define a predetermined clearance between said cutting blades and said anvil cutting edges;

a vertical support web affixed between said frame ends integral with said anvil, said support web being disposed in a vertically supporting manner with said elongated anvil to reinforce and support said anvil against cutting;

a pair of converging infeed plates carried adjacent an open top of said frame arranged at a prescribed angle to a infeed nip of said first and second cutting blade rotors for properly feeding said material to said rotors for cutting;

a first arcuate screen carried longitudinally coextending with said first cutting blade rotor;

a second arcuate screen carried longitudinally coextending with said second cutting blade rotor; and said arcuate screens carried in close proximity to said cutting blade rotors and having a plurality of perforations, and said arcuate screens being contoured corresponding to said rotors to define a prescribed clearance between said cutting blades and said perforated screens so that said material is repeated comminuted until said material is reduced in size sufficiently to fall through said perforations of said arcuate screens.

22. The apparatus of claim 21 including fasteners for affixing said arcuate screens to said anvil at a first free edge thereof and for affixing said arcuate screens to said inclined infeed plates at a second free edge thereof.

23. The apparatus of claim 21 including a pair of cutout openings formed coaxially in said first and second frame ends, a boss carried on each opposing end of said anvil received in said cutout openings of said first and second ends for mounting said anvil between said first and second frame ends in a level condition so that a precision parallel alignment is provided between said anvil cutting edges and said rotor cutting blades in which said predetermined clearance is set, and means fixing said bosses in said cutout openings in said precision alignment.

24. The apparatus of claim 21 including:

a first hydraulic drive motor having a rotary output with an axis of rotation;

a first direct drive fitting connecting said rotary output of said first hydraulic motor and a drive journal of said first cutting blade rotor so that said rotor axis and rotational axis of said rotary sleeve coincide;

a second hydraulic drive motor having a rotary output with an axis of rotation; and a second direct drive fitting connecting said rotary output of said second hydraulic motor and said drive journal of said second cutting blade motor so that said rotor axis and rotational axis of said rotary sleeve coincide.

25. The apparatus of claim 24 wherein:

said first and second rotary outputs include drive sleeves for receiving said drive journal of said first and second cutting blade rotors; and said first and second direct drive fittings include a compression connector surrounding said drive sleeves of said hydraulic motors with said drive journals received within said drive sleeves for providing a direct connection between said drive sleeves and said drive journals of said cutting blade rotors.

26. The apparatus of claim 21 wherein each of said cutting blade rotors comprises a plurality of blade pockets spaced axially and circumferentially about an outer surface of said rotors;

said blade pockets including a blade support heel recessed in said rotor surface which encloses a rear portion of said blade pockets;

said cutting blades comprising mounting blocks having at least one rounded body portion; and said rounded body portions of said mounting blocks mating with and being received in said support heels of said blade pockets so that said support heels reinforce the mounting of said cutting blades against cutting of said material.

27. The apparatus of claim 26 wherein said blade pockets include a first row of pockets arranged in at least one generally v-shaped diverging pattern which includes a center pocket with blade pockets spaced on opposing sides of said center pocket diverging axially and circumferentially in the direction of rotation so that the tendency of said cut material to spread towards the ends of said cutting rotors is reduced.

28. The apparatus of claim 27 including a second row of blade pockets trailing said first row of blade pockets arranged in at least said one diverging pattern wherein a center line of said blade pockets of said second row are laterally off-set from the center lines of said blade pockets of said first row so that a substantially continuous cut line is provided by cutting blades mounted in said first and second rows of blade pockets along an axial length of said cutting blade rotors.

29. The apparatus of claim 26 wherein said cutting blade rotors are machined from a solid stock of steel.

30. The apparatus of claim 21 wherein said anvil includes an anvil block and a bed knife carried by said anvil block having a pair of corner cutouts, and hardened material inserts carried in said corner cutouts forming said first and second cutting edges.

31. The apparatus of claim 21 including a first cutting zone defined between opposing cutting blades carried on said first and second rotors in which said material is cut above said anvil, a second cutting zone defined between said rotor cutting blades and said anvil cutting edges in which said material is cut, and a third cutting zone defined between said cutting blades of said first and second rotors and said first and second arcuate screens in which said material is cut.

* * * * *